US007382097B2

(12) United States Patent
Seredich et al.

(10) Patent No.: US 7,382,097 B2
(45) Date of Patent: Jun. 3, 2008

(54) INJECTION MOLDED CERAMIC METAL HALIDE ARC TUBE HAVING NON-TAPERED END AND METHOD OF FORMING SAME

(75) Inventors: Douglas Seredich, Montville, OH (US); Curtis E. Scott, Mentor, OH (US); Charles Greskovich, Schenectady, NY (US); Todd R. Springer, Twinsburg, OH (US)

(73) Assignee: General Electric Company, Schenectady, NY (US)

( * ) Notice: Subject to any disclaimer, the term of this patent is extended or adjusted under 35 U.S.C. 154(b) by 92 days.

(21) Appl. No.: 10/931,169

(22) Filed: Aug. 31, 2004

(65) Prior Publication Data

US 2005/0023982 A1 Feb. 3, 2005

Related U.S. Application Data

(63) Continuation of application No. 10/369,162, filed on Feb. 19, 2003, now abandoned, which is a continuation of application No. 09/644,370, filed on Aug. 23, 2000, now abandoned.

(51) Int. Cl.
*H01J 61/30* (2006.01)
*H01J 61/36* (2006.01)
*H01J 9/26* (2006.01)

(52) U.S. Cl. ..... 313/634; 313/623; 313/573

(58) Field of Classification Search ..... 313/634, 313/573, 567, 623, 493, 625, 626
See application file for complete search history.

(56) References Cited

U.S. PATENT DOCUMENTS

| | | | | |
|---|---|---|---|---|
| 4,625,149 | A * | 11/1986 | Danno et al. | 313/623 |
| 4,765,820 | A | 8/1988 | Naganawa et al. | |
| 4,808,881 | A | 2/1989 | Kariya et al. | |
| 4,972,119 | A | 11/1990 | Kariya et al. | |
| 4,975,620 | A | 12/1990 | Masui et al. | |
| 5,742,123 | A | 4/1998 | Nagayama | |
| 5,866,982 | A * | 2/1999 | Scott et al. | 313/634 |
| 6,004,503 | A * | 12/1999 | Neil | 264/632 |
| 6,126,887 | A | 10/2000 | Ward et al. | |
| 6,313,582 | B1 | 11/2001 | Miyanaga et al. | |
| 6,583,563 | B1 * | 6/2003 | Venkataramani et al. | 313/634 |
| 6,979,421 | B2 * | 12/2005 | Neil et al. | 264/642 |

FOREIGN PATENT DOCUMENTS

| | | | |
|---|---|---|---|
| JP | 404370644 | A | 12/1992 |
| JP | 404370648 | A | 12/1992 |

* cited by examiner

*Primary Examiner*—Karabi Guharay
(74) *Attorney, Agent, or Firm*—Fay Sharpe LLP

(57) ABSTRACT

An arc tube for a ceramic metal halide lamp includes a hollow first body member (40) that is tapered along a majority of its length to aid in removing the molded component from a pin during assembly. An open end (46) of the first body member has a constant diameter (60) allowing it to be joined to a constant diameter portion (72) of the second body member or end cap (70). The mating constant diameter portions ensure that the hollow first body member can be monolithically joined with the end cap with a reduced level of seal voids.

18 Claims, 1 Drawing Sheet

INJECTION MOLDED CERAMIC METAL HALIDE ARC TUBE HAVING NON-TAPERED END AND METHOD OF FORMING SAME

This is a continuation of application Ser. No. 10/369,162, filed on Feb. 19, 2003, now abandoned, which is a continuation of application Ser. No. 09/644,370, filed on Aug. 23, 2000, now abandoned.

BACKGROUND OF THE INVENTION

1. Field of the Invention

The present invention relates to ceramic tubes and methods of forming same, and more particularly to ceramic arc tubes used in ceramic metal halide lamps.

2. Discussion of the Art

Ceramic arc tubes used for discharge lamp chambers were developed to operate at high temperatures on the order of 950° C. and higher. These types of lamps exhibit improved color temperature, color rendering, and luminous efficacies. Typically, ceramic discharge chambers are constructed from a number of individual components that are extruded or die-pressed from a ceramic powder. Prior practice employed a five component construction that included a central hollow cylinder substantially closed at either end by first and second plugs to which first and second legs were joined to the end plugs.

More recent developments have been directed to minimizing the number of joints, i.e., reducing the number of individual components, to establish an improved sealed arc chamber. For example, U.S. Pat. No. 6,004,503 discloses a method of making a ceramic arc tube for a metal halide lamp comprised of two components, i.e., a hollow body and an end cap. The '503 patent describes a two-part arc tube produced with a hollow body having an open end with a diameter approximately three to six percent (3-6%) greater than the opposite, closed end. That is, the hollow tube is tapered along its length and the patent disclosure is void of any description regarding the hermetic seal formed between the hollow body and the end cap. In the past, these components have been extruded or pressed and subsequently heated or fired to integrally sinter and join the components together.

Current injection molding practice for molding hollow body parts or cylindrical components employs a taper on a mold pin to aid in removing the part after molding. The degree of taper ranges from about one-half percent to about six percent (0.5%-6%) along the length of the pin. While this may be acceptable for many molded assemblies, the tapered conformation presents problems where a tapered end of one component joins a second component having a non-tapered surface. In attempting to monolithically join the components together, e.g., sealing or bonding the hollow body to the end cap, to form a hermetically sealed ceramic arc discharge tube, the mating of the two non-parallel surfaces has been determined to be very problematic. This is because of potential seal voids forming at the joined interface and precluding a hermetic seal. Thus, improving manufacturing steps, components, and addressing these needs will lead to longer-life lamps having improved monolithic seals between the hollow body and end cap.

BRIEF SUMMARY OF THE INVENTION

A ceramic arc tube for a metal halide lamp includes a first body portion open at a first end and having a tapered wall extending along its length and a cylindrical region spaced inwardly from the first end and receiving a second body member hermetically sealed along the cylindrical region.

The first body member has a tapered internal wall that, in a preferred arrangement tapers at a rate of at least approximately 0.5° over its length.

The tapered wall can is also taper along its external surface to define a substantially constant wall thickness over its length.

A method of making a ceramic arc tube for a metal halide lamp includes the steps of forming a first body portion having a hollow body region open at a first end. Providing a taper on the hollow body over substantially its entire length and forming a cylindrical internal region at the open first end for receiving a second body portion.

DETAILED DESCRIPTION OF THE INVENTION

Figure 1:
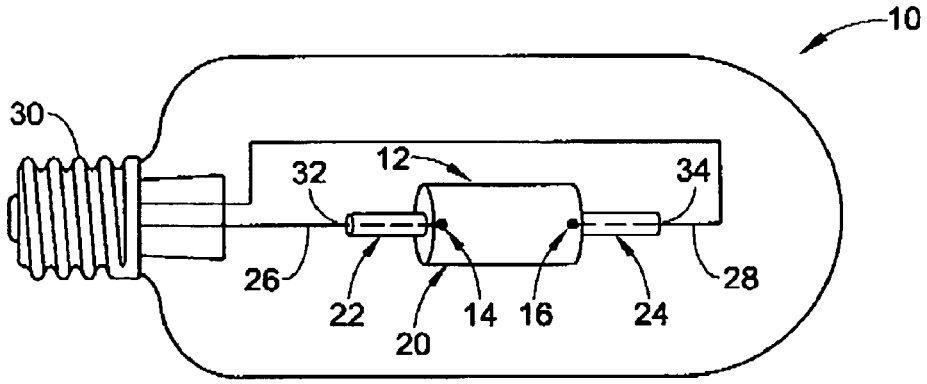
FIG. 1 generally illustrates a lamp assembly incorporating a ceramic discharge chamber.

FIG. 1 illustrates a ceramic discharge lamp 10 that includes a double ended discharge chamber 12 that receives first and second electrodes 14; 16. The electrodes extend into the chamber and a fill material is encapsulated in the discharge chamber so that upon application of an electrical potential difference across the electrodes, an arc is produced that ionizes the film material to produce a plasma in the discharge chamber in a manner well known in the art. For ceramic metal halide lamps, the fill material typically includes a mixture of mercury (Hg), a rare gas such as argon (Ar) or xenon (Xe), and a metal halide such as NaI, TlI, or $DyI_3$. Other examples of fill materials are well known in the art and do not form a particular part of the present invention so that further discussion herein is deemed unnecessary.

A central body member 20 includes first and second legs 22, 24 extending from opposite ends of the chamber. Lead wires 26 and 28 pass through the legs and extend therefrom for connection with a lamp contact or connector 30, such as an Edison type base, although other electrical connections can be used without departing from the scope and intent of the present invention. Seals are preferably formed at opposite ends about the lead wires or conductors that extend into the first and second legs. The seals are preferably made with a glass frit that, when the glass is melted, flows into the legs to form a seal between the conductor and the leg.

As indicated above, it is desirable to reduce the number of components that comprise the discharge chamber and similarly reduce the number of bonds or joints between the components. This expedites the assembly of the discharge chamber and reduces the number of potential bond defects during manufacture, as well as reduces the possibility of breaking the discharge chamber at a bond region during handling. Accordingly, and by way of example, two part ceramic metal halide arc tubes are preferred to reduce the number of seals in the monolithic joining areas.

Die designs for injection molding require a wall taper be built into the dies in order to remove the molded components. Thus, as is evident in FIG. 2, body portion 20 includes a hollow first body member 40 that has a tapered wall 42 that extends over a substantial portion of the length of the first body member. The internal taper 42 is preferably matched by an external taper 44 to define a generally constant wall thickness over a substantial length of the first body member. A first end 46 of the first body member is open while the second end 48 defines an integral end wall or cap having an integral leg portion 50 extending therefrom that ultimately defines one of the legs 22, 24 of the discharge chamber assembly. It will be further appreciated that opening 52 is provided in the leg to receive the lead or conductor assembly that provides electrical connection to the electrodes 14, 16.

In accordance with the present invention, a hollow cylindrical portion 60 extends inwardly a predetermined dimension from the open first end to a location 62. The hollow cylindrical portion 60 cooperates with a second body member 70, and particularly a cylindrical portion 72 thereof. Shoulder 74 is adapted to abuttingly engage the outer end of the first body member and provide a positive fit and insertion of the second body member into the first body member. Preferably, the second body member or end cap includes an integrally formed leg 76 having an opening 78 adapted to receive the other lead/conductor/electrode assembly as is apparent to one skilled in the art.

Figure 2:
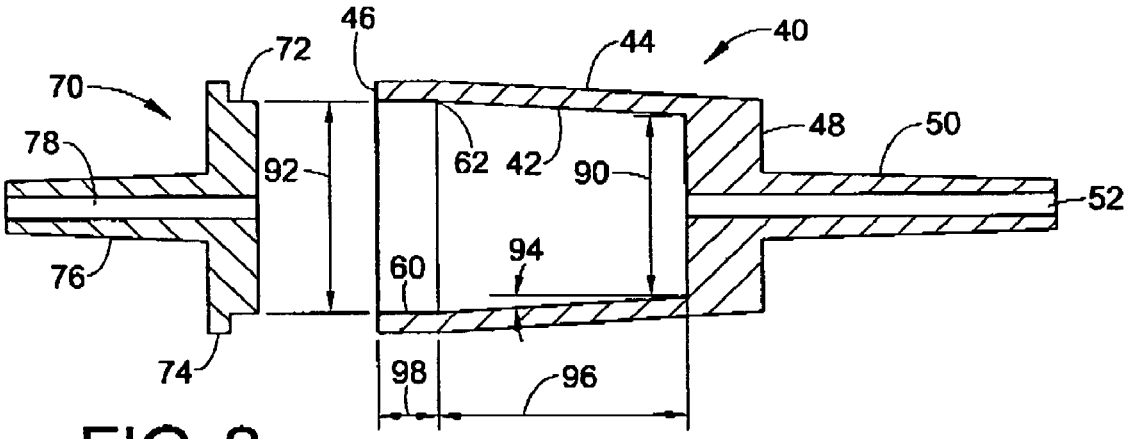
FIG. 2 is an enlarged, longitudinal cross-sectional view of the present invention.

As illustrated in FIG. 2, the right-hand end of the hollow portion of the first body member 40 has a first cross-sectional dimension or diameter 90. The wall taper 42, for example on the order of one-half degree (0.5°) proceeds or enlarges to a second dimension at location 62 shown by the second cross-sectional dimension or diameter 92. From location 62 to the open end, i.e., leftwardly as shown, the hollow cylindrical portion 60 has a substantially constant diameter for advantageously joining to the non-tapered surface 72 of the end cap 70. The taper angle (on the order of 0.5° or where the open end has a diameter approximately three to six percent (3-6%) greater than the closed end) is identified by reference angle 94 and proceeds along the substantial or major length of the hollow body member as referenced by longitudinal dimension 96. The axial length identified by reference numeral 98 represents the constant diameter portion. It is contemplated that the axial length 98 is dimensioned to fully receive the non-tapered surface 72.

In contrast to a tapered portion of a first body member engaging a tapered portion of the second body member as shown in the U.S. Pat. No. 6,004,503 patent, the two surfaces 60, 72 mated in accordance with the present invention are parallel. This ensures that the hollow cylindrical part can be efficiently ejected off the pin and still achieve the desired differential shrinkage and monolithic join produced with the end cap as illustrated in FIG. 2. Also, using a non-tapered plug or end cap is desirable in achieving an interference fit and dimensional control during sintering. As the outside tube shrinks around a tapered plug, it may have a tendency to push the plug outwardly from the tube. This would not occur with the arrangement of the present invention. Seal voids associated with the prior designs are avoided and the joined interface provides the desired hermetic seal between the components.

Figure 3:
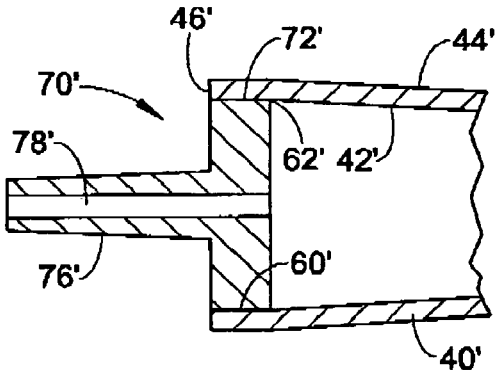
FIG. 3 is an enlarged view similar to FIG. 2 and illustrating a second configuration of the second body member.

FIG. 3 shows a different conformation of the second body member or end cap 70' that is received in the open end of the first body member 40' and sealed thereto. For purposes of consistency and brevity, like components are identified by like reference numerals with a primed suffix (') and new components are identified by new numerals. Unless specifically noted, the structure and function is substantially identical to the embodiment of FIG. 2. The mating surfaces are monolithically joined and the parallel interface extending over a few millimeters reduces the level of seal voids.

The invention has been described with reference to the exemplary embodiment. Modifications and alterations will occur to others upon reading and understanding this specification. For example, the concepts of the present invention may be applicable to single ended ceramic discharge lamps and methods. Likewise, the configuration of the first and second body member may be additionally altered from the arrangements shown in FIGS. 2 and 3, without departing from the present invention. In any event, the novel arrangement of providing a taper along a substantial portion of the hollow cylindrical member that is parallel at one end to provide an acceptable monolithic join will still be achieved. It will also be appreciated that the body member and the end cap can adopt a wide variety of configurations and are not limited to the conformations shown in the drawings. For example, curved recesses can be integrally formed in the body member and/or end cap, or the legs can be formed in one of the body member and end cap. The invention is intended to include such modifications and alterations in so far as they come within the scope of the appended claims or the equivalents thereof.

What is claimed is:

1. A ceramic arc tube for a metal halide lamp comprising:

a hollow first body member having first and second ends, the hollow body member being open at the first end and having a continuous, tapered wall along its length from the second end to a location spaced inwardly from the first end and a cylindrical region having a substantially constant diameter internal wall extending from the location to the first end at an angle different than the tapered wall, the tapered wall extending over a greater extent of the first body member than the cylindrical region; and a second body member hermetically sealed to the first body member along the cylindrical region.

2. The ceramic arc tube of claim 1 wherein the first body member has a substantially constant wall thickness over its length.

3. The ceramic arc tube of claim 1 wherein the second end of the first body member includes a leg extending therefrom.

4. The ceramic arc tube of claim 3 wherein the second body member includes a plug integrally formed with a leg.

5. The ceramic arc tube of claim 1 wherein the first body member has a tapered internal wall.

6. The ceramic arc tube of claim 1 wherein the tapered wall tapers at a rate of approximately one-half degree (0.5) over its length.

7. The ceramic arc tube of claim 6 wherein the first member further comprises a tapered external wall along its length.

8. The ceramic arc tube of claim 1 wherein the first body member has a tapered internal wall that tapers so that one end has a diameter approximately three to six percent (3-6%) greater than the other end.

9. A method for making a ceramic arc tube for a metal halide lamp comprising the steps of:

forming a hollow first body member having a first end and a second end, and wherein the first end is open;

providing a continuous taper on the hollow first body member over substantially its entire axial length from the second end to adjacent the first end; and forming a cylindrical internal region extending axially inward from the open first end, the cylindrical internal region having an angle different than the taper of the first body member.

10. The method of claim 9 comprising the further step of monolithically joining the first body member to a cylindrical portion of a second body member.

11. The method of claim 10 comprising the further step of integrally forming a leg on the first body member.

12. The method of claim 11 comprising the further step of integrally forming a leg on the second body member.

13. The method of claim 9 comprising the further step of integrally forming a leg on the first body member.

14. A ceramic metal halide lamp comprising:

a hollow first body member having first and second ends, and being open at the first end, the hollow body having a tapered internal wall that continually increases from the second end to the first end along a major portion of its length and a cylindrical region having a substantially constant diameter internal wall extending inwardly from the first end to a predetermined location, the tapered wall being at an angle different than the substantially constant diameter internal wall;

a second body member having a cylindrical region that is hermetically sealed to the cylindrical region of the first body member to define an arc chamber; and first and second electrodes extending inwardly into the arc chamber.

15. The ceramic metal halide lamp of claim 14 wherein the second body member includes a shoulder adjacent the cylindrical region that abuttingly engages the end of the first body member.

16. The ceramic metal halide lamp of claim 14 wherein the first body member has a substantially constant wall thickness over its length.

17. The ceramic metal halide lamp of claim 14 wherein the second end of the first body member includes a leg extending therefrom.

18. The ceramic metal halide lamp of claim 17 wherein the second body member includes a plug integrally formed with a leg.

* * * * *